US009393706B2

(12) United States Patent
Quadagno

(10) Patent No.: US 9,393,706 B2
(45) Date of Patent: Jul. 19, 2016

(54) SLIDE OPERATED SCISSORS

(71) Applicant: Qscissors, Inc., North Palm Beach, FL (US)

(72) Inventor: Gregory Quadagno, Jupiter, FL (US)

(73) Assignee: Qscissors, Inc., North Palm Beach, FL (US)

( * ) Notice: Subject to any disclaimer, the term of this patent is extended or adjusted under 35 U.S.C. 154(b) by 82 days.

(21) Appl. No.: 14/280,251

(22) Filed: May 16, 2014

(65) Prior Publication Data

US 2014/0338200 A1 Nov. 20, 2014

Related U.S. Application Data

(60) Provisional application No. 61/824,756, filed on May 17, 2013.

(51) Int. Cl.
*B26B 13/28* (2006.01)

(52) U.S. Cl.
CPC ..... *B26B 13/28* (2013.01)

(58) Field of Classification Search
CPC ..... B26B 13/28
See application file for complete search history.

(56) References Cited

U.S. PATENT DOCUMENTS 590,330 A 9/1897 Nolan
1,479,908 A * 1/1924 Goshia ..... B26B 13/20 30/271
1,533,039 A * 4/1925 Shirk ..... B26B 13/26 30/250
2,005,456 A 6/1935 Creager
2,158,277 A 5/1939 Dolph
2,550,874 A * 5/1951 Arvid ..... B26B 13/26 30/190
2,744,324 A 5/1956 Chuba
4,140,124 A 2/1979 Curutchet
4,146,961 A 4/1979 Pinto
4,241,503 A * 12/1980 Sugiyama ..... B26B 13/285 30/268
4,642,895 A 2/1987 Gauvry
4,742,617 A * 5/1988 Gauvry ..... B26B 13/20 30/232
5,109,608 A 5/1992 Pracht
5,469,624 A 11/1995 Brenton et al.
5,781,999 A 7/1998 Chang
6,249,977 B1 6/2001 Knoop
6,457,241 B1 10/2002 Droin
6,883,238 B1 4/2005 Tran
7,424,778 B2 * 9/2008 Brenton ..... B26B 13/20 30/266
7,464,474 B2 12/2008 Ishida
7,530,172 B1 * 5/2009 Wu ..... A01G 3/0251 30/244
D612,696 S 3/2010 Iwase
7,926,186 B2 * 4/2011 McLoughlin ..... A62C 8/00 30/244
7,966,733 B2 6/2011 Jun
8,176,638 B2 5/2012 Hann et al.

(Continued)

*Primary Examiner* — Hwei C Payer
(74) *Attorney, Agent, or Firm* — McHale & Slavin, P.A.

(57) ABSTRACT

The present invention relates to the field of hand-operated scissors and shears having an ergonomic design in which one of the blade members is slide operated so as to better conform to the configuration of the operator's hand and the desired cutting orientation of the device. The system includes a first blade having a shank and at least one finger ring. A second blade is provided with a pivot to cross the first blade. The second blade having a guide channel in the proximal end thereof. A slide assembly cooperates with a track formed into the shank of the first blade and a thumb ring is secured to the slide assembly. In operation, the users causes the blades to open and close with respect to each other by reciprocating the slide assembly along the track, thereby eliminating the opening and closing motion required in the scissors of the prior art.

20 Claims, 6 Drawing Sheets

(56) References Cited

U.S. PATENT DOCUMENTS

| | | | | |
|---|---|---|---|---|
| 8,756,818 | B2 * | 6/2014 | Fitraki | B26B 13/28 30/254 |
| 2002/0129497 | A1 | 9/2002 | Lyddon et al. | |
| 2003/0106222 | A1 | 6/2003 | Huang | |
| 2004/0211068 | A1 | 10/2004 | Yusufov et al. | |
| 2005/0005456 | A1 | 1/2005 | Wang et al. | |
| 2005/0204569 | A1 | 9/2005 | Brenton | |
| 2006/0010695 | A1 | 1/2006 | Wu | |
| 2006/0021230 | A1 * | 2/2006 | Mikami | B26B 13/28 30/194 |
| 2006/0064879 | A1 | 3/2006 | Lauritzen et al. | |
| 2008/0172886 | A1 * | 7/2008 | Jun | B26B 13/20 30/232 |
| 2010/0192384 | A1 | 8/2010 | Fox | |
| 2010/0242289 | A1 | 9/2010 | Roskam et al. | |
| 2012/0079724 | A1 | 4/2012 | Huang | |
| 2014/0338200 | A1 * | 11/2014 | Quadagno | B26B 13/28 30/239 |

* cited by examiner

SLIDE OPERATED SCISSORS

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 61/824,756, entitled "SLIDE OPERATED SCISSORS", filed May 17, 2013. The contents of which the above referenced application is incorporated herein by reference in its entirety.

FIELD OF INVENTION

The present invention generally relates to the field of cutting devices, and more particularly to the field of hand-operated scissors and shears having an ergonomic design in which one of the blade members is slide operated so as to better conform to the configuration of the operator's hand and the desired cutting orientation of the device.

BACKGROUND INFORMATION

In general, scissors are a device comprising two blades that are connected together such that, when an operator applies manual pressure, the blades slide past each other, producing a shearing action that cuts a material inserted between the blades. The earliest scissors, dating back over 3000 years to ancient Egypt, were of the "spring" design, having two blades connected at the handle by an arcuate strip of metal that keeps the blades apart until manual pressure is applied. The current "cross-bladed" design originated with the Romans about 100 AD. In this form, scissors comprise two blades conjoined at a pivot, with each blade connected via a shank to a ring or loop that accommodates one or more fingers. Mechanically, such scissors constitute a first-class double-lever system, with the pivot acting as the common fulcrum.

Scissors can be configured as either right-handed or left-handed, with one configuration being the mirror-image of the other. When the blades are fully separated, the scissors are said to be in an open position, as opposed to the closed position, in which the blades fully engage each other along their length.

Aside from anatomical variability, the uses to which scissors are put will also influence the optimum ergonomic design. In cutting cloth, for example, the scissors are usually held vertically, with the tip pointing away from the operator. In cutting human hair, on the other hand, the scissors may be held vertically, for trimming the temples, or horizontally, for trimming the top of the head, with the tip generally pointing to the left for a right-handed operator. Pet groomers, however, will also need to hold the scissors vertically, with the tip pointing up or down, in order to trim the flanks and legs of the animal. Since the orientation of the hand on the scissors will be different in each of these applications, no single non-adjustable design will be ergonomically optimal for all of them.

The prior art includes a number of designs that are adjustable with respect to one or more parameters. These parameters include: Thumb offset: the location of the thumb ring with respect to the finger ring; Thumb/finger ring rotation: to control roll, yaw and pitch; and Thumb/finger ring size adjustment.

Several patents provide for a thumb ring that floats along the lower shank of the scissors. The earliest of these dates back to 1923 in the patent of Gosha, U.S. Pat. No. 1,479,908. Later examples are the patents of Dolph, U.S. Pat. No. 2,158, 277, disclosing a ratchet clip mount for a finger ring. Chuba, U.S. Pat. No. 2,744,324, discloses a pinch bolt arrangement for securing a thumb ring along the length of the shank, and Pinto, U.S. Pat. No. 4,146,961 discloses a perpendicularly oriented thumb loop adjustably secured to the shank with a fastener.

Pivoting thumb rings of various types are disclosed in the prior art going as far back as 1897, in the Nolen patent, U.S. Pat. No. 590,330. Later examples of pivoting thumb ring designs are the Pracht patent, U.S. Pat. No. 5,109,608 and the Brenton application, US 2005/0204569. In each of these designs, the thumb ring rotates about the vertical axis however, operation of the scissor blades still requires the operator's hand to open and close in a typical fashion which results in fatigue and may result in more serious consequences such as carpal tunnel syndrome.

Gauvrey, U.S. Pat. No. 4,642,895, discloses a thumb ring mounted on a sleeve that slides along the lower shaft of the scissors. The thumb ring includes a ball and socket arrangement that allows the thumb ring to pivot polyaxially with respect to the shank.

Lauritzen et al., Pub. No. US 2006/0064879, teaches a thumb ring that's integrated with a sleeve which slides along a shortened lower shaft and also rotates around the lower shaft. A ball-and-socket joint connecting the finger ring to a curved upper shaft enables rotation of the finger ring. However, like Gauvey, the scissors must still be opened and closed in a conventional manner.

None of these provide for alternative motion to operate the blades of the scissors. Consequently, these designs cannot provide an ergonomic motion for the operator's thumb and ring finger, which will diminish efficiency and comfort of use. Nor do these designs provide any means for rotating the thumb and/or finger rings to achieve optimal control over the roll, yaw and pitch of the scissors. Without such rotation features, all rotational movement must be achieved purely by wrist movements. While the anatomy of the wrist comfortably lends itself to rolling rotation, through a range of about 180 degrees, the same is not true of yaw and pitch, which demand awkward twisting of the wrist through a very constrained range of motion.

Consequently, there remains a need, as yet unmet by the prior art, for ergonomic scissors that eliminate the hand motions required by typical scissor constructions. Finally, there are ergonomic needs that scissors having an alternative operative motion must satisfy in order to achieve acceptance by the end user. The scissors should also be easily and quickly disassembled and reassembled for cleaning and maintenance using minimal hardware and requiring a minimal number of tools. Further, the system should not require excessive strength to assemble or include hard to manipulate component parts. Moreover, the system must assemble together in such a way so as not to detract from the aesthetic appearance of the scissors.

Thus, the present invention provides slide operated scissors which overcome the disadvantages of prior art scissors and shears. The slide operated scissors of the present invention not only provide for alternative operative motion, they also provide relative ease in the disassembly and reassembly for maintenance and cleaning.

SUMMARY OF THE INVENTION

Briefly, the present invention relates to the field of hand-operated scissors and shears having an ergonomic design in which one of the blade members is slide operated so as to better conform to the configuration of the operator's hand and the desired cutting orientation of the device. The system includes a first blade having a shank and at least one finger ring. A second blade is provided with a pivot to cross the first blade. The second blade having a guide channel in the proximal end thereof. A slide assembly cooperates with a track formed into the shank of the first blade and a thumb ring is secured to the slide assembly. In operation, the users causes the blades to open and close with respect to each other by reciprocating the slide assembly along the track, thereby eliminating the opening and closing motion required in the scissors of the prior art.

Accordingly, it is an objective of the present invention to provide a scissor assembly having an alternative operative motion.

It is a further objective of the present invention to provide a slide operated scissor assembly.

It is yet a further objective of the present invention to provide a slide operated scissor assembly wherein a track is formed or secured to the blade opposite the blade operated by the slide assembly.

Other objectives and advantages of this invention will become apparent from the following description taken in conjunction with the accompanying drawing's wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENTS

Figure 1A:
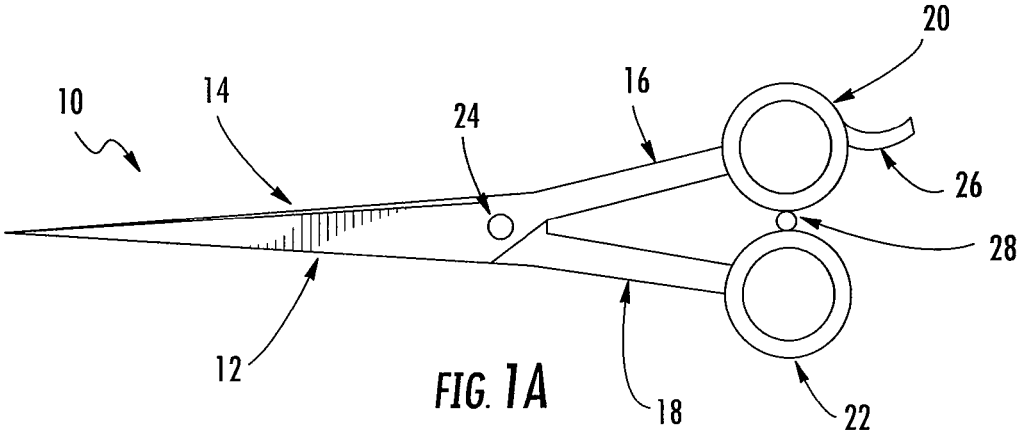
FIG. 1A PRIOR ART
FIG. 1A is a side view illustrating a prior art scissor assembly.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

For the purpose of establishing terminology and spatial orientation, FIG. 1A illustrates a typical pair of right-handed cross-bladed scissors 10 in a side view of the closed position. In this illustration, the blades 12, 14 are aligned with the vertical plane. The scissors comprise a first blade 12, a second blade 14, an upper shank 16, a lower shank 18, a finger ring 20, a thumb ring 22, a pivot 24, a tang 26 and a thumb stop 28. The proximal end of the first blade 12 transitions into the upper shank 16, which in turn transitions into the finger ring 20, which in turn transitions into the tang 26. The proximal end of the second blade 14 transitions into the lower shank 18, which in turn transitions into the thumb ring 22, which in turn transitions into the thumb stop 28. The two blades are pivotally connected near their proximal ends by the pivot 24, which is typically a screw or pin. In the closed position, the thumb stop 28 engages the finger ring 20 or the upper shank 16, thereby preventing the blades from crossing beyond the fully overlapped position so as to avoid excessive blade wear and/or deformation.

In the exemplary right-handed configuration of FIG. 1A, the index and middle fingers of the operator's right hand rest on the upper shank 16; the ring finger is inserted into the finger ring 20; the pinkie finger rests on the tang 26; and the thumb is inserted into the thumb ring 22. When the operator's hand is opened, the leverage of the increased separation between the ring finger and thumb causes the first and second blades to diverge in a V-form from the pivot, thus putting the scissors in an open position. When the operator's hand is closed, the leverage of the diminished separation between the ring finger and thumb causes the first and second blades to converge in a V-form at the pivot, thus putting the scissors in a closed position.

Figure 1B:
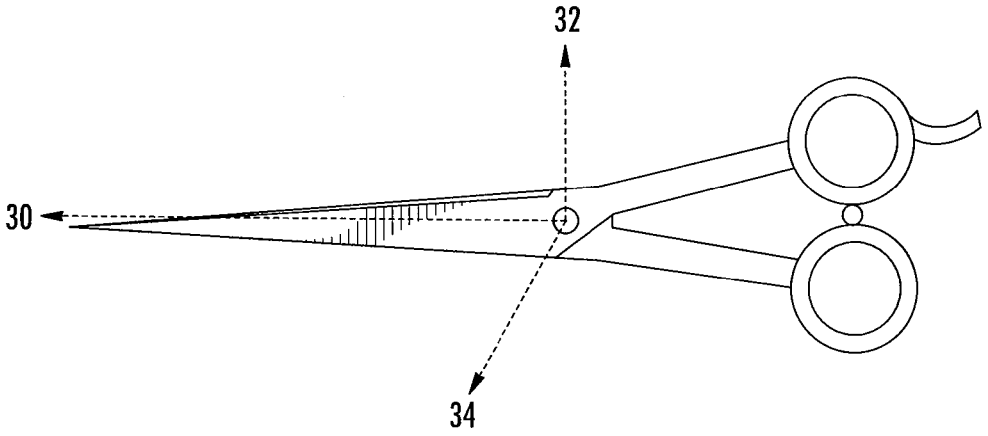
FIG. 1B PRIOR ART
FIG. 1B is a side view illustrating a side view of a prior art scissor assembly.
Figure 2:
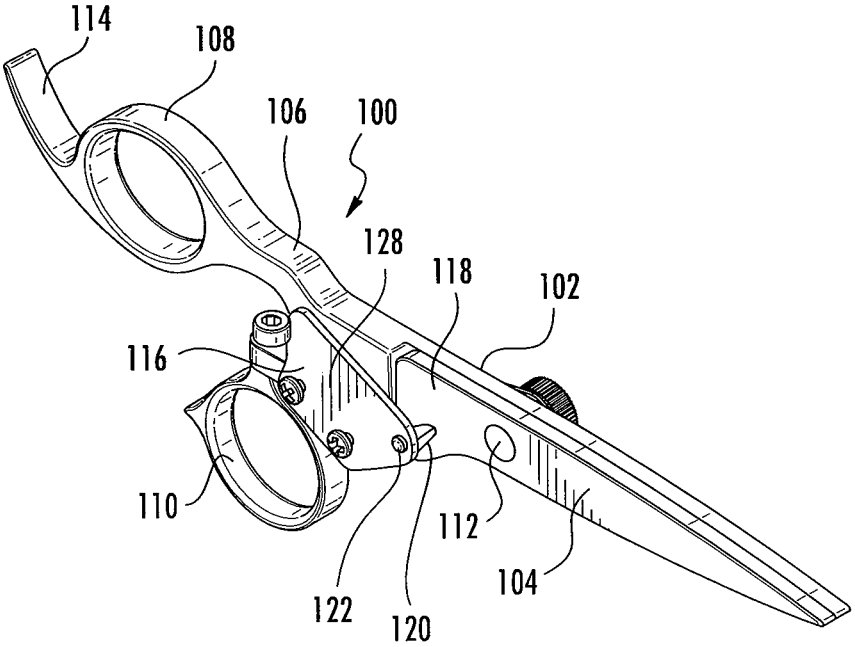
FIG. 2 is a top front perspective view of the preferred embodiment of the present device.
Figure 3:
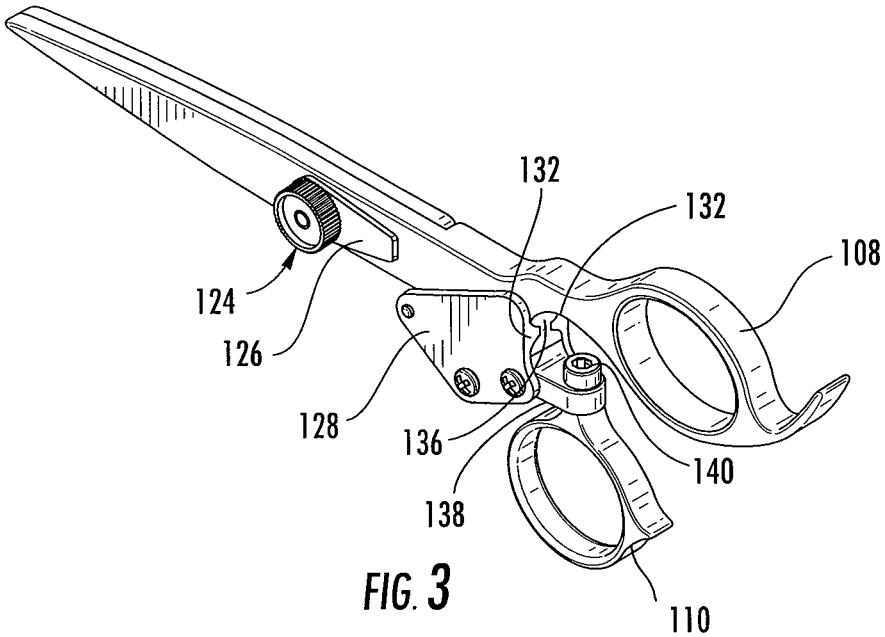
FIG. 3 is a top rear perspective view of the embodiment illustrated in FIG. 2.
Figure 4:
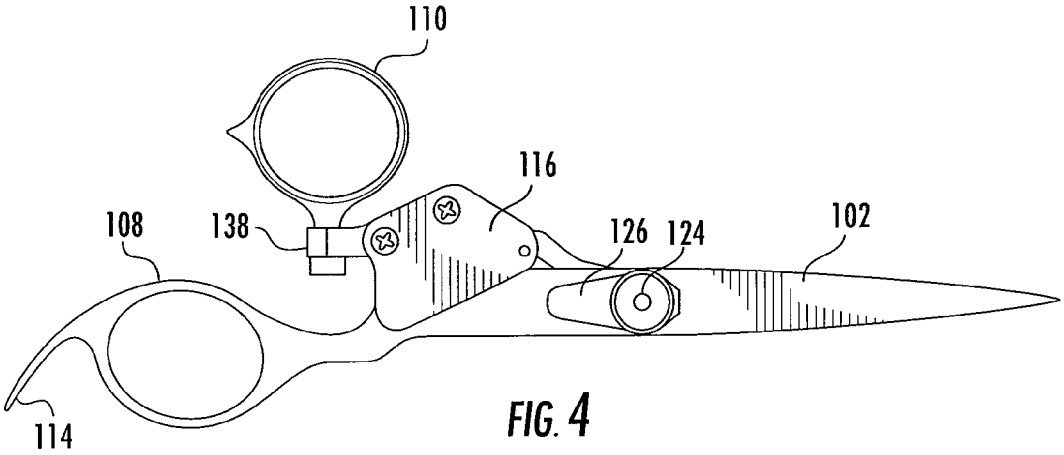
FIG. 4 is a side view of the embodiment illustrated in FIG. 2.
Figure 5:
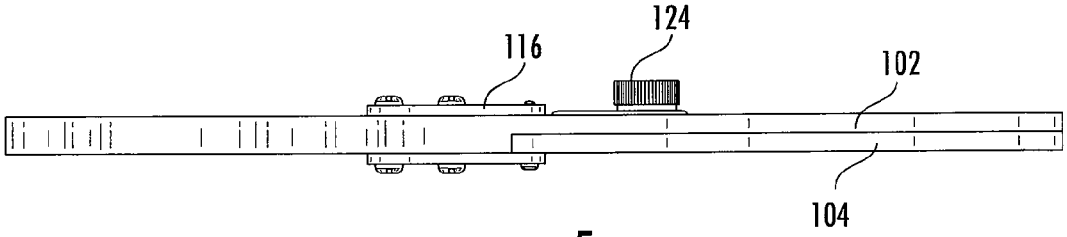
FIG. 5 is a top view of the embodiment illustrated in FIG. 2.
Figure 6:
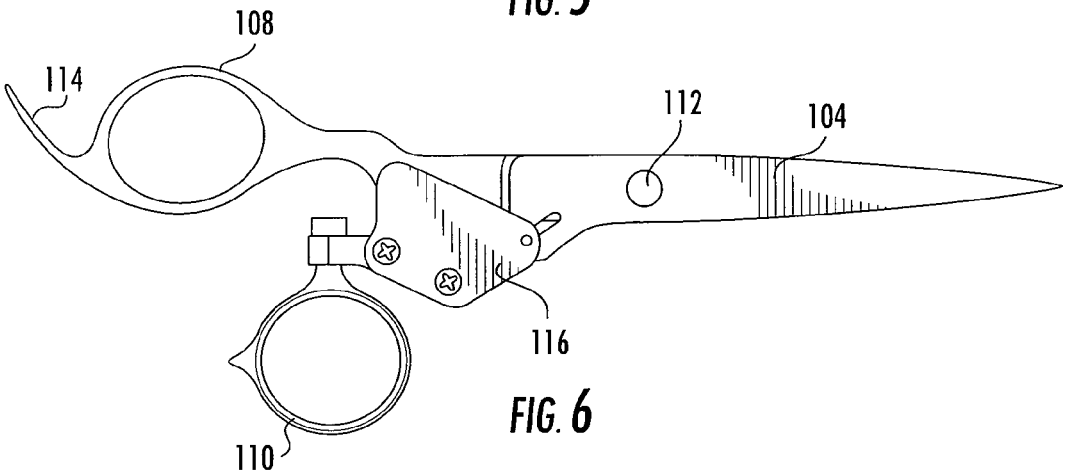
FIG. 6 is a side view of the embodiment illustrated in FIG. 2.
Figure 7:
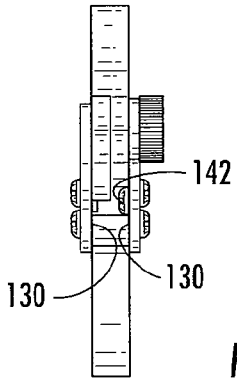
FIG. 7 is a front view of the embodiment illustrated in FIG. 2.

FIG. 1B depicts the same exemplary scissors as FIG. 1A, again in a side view of the closed position, showing the three axes about which the scissors can rotate. The longitudinal axis 30 extends forward along the line that connects the pivot to the distal tip of the blades. The vertical axis 32 extends upward from the pivot perpendicular to the longitudinal axis in the vertical plane. The horizontal axis 34 extends laterally leftward from the pivot perpendicular to the longitudinal axis in the horizontal plane. For a right-handed pair of scissors, as illustrated in FIG. 1B, the vertical axis 32 is oriented clockwise with respect to the longitudinal axis 30, while the horizontal axis 34 is oriented counterclockwise with respect to the longitudinal axis. For a left-handed pair of scissors (not shown) the vertical axis would be oriented counterclockwise with respect to the longitudinal axis, while the horizontal axis would be oriented clockwise with respect to the longitudinal axis.

Still referring to FIG. 1B, the scissors can rotate in three different planes: about the longitudinal 30, vertical 32 or horizontal axes 34. Borrowing the terminology of aeronautics, we can refer to these three types of rotation as "roll", "yaw" and "pitch", respectively. Ergonomically efficient scissors, therefore, must be designed so that the anatomy of the human hand and wrist is compatible with controlling the roll, yaw and pitch of the scissors without engendering undue physical strain and/or fatigue. One of the problems in creating such an ergonomic design is the wide variability of human anatomy in terms of the size of individual hands and wrists and the length and spacing of the fingers. Consequently, a pair of scissors that's designed for the average person will prove awkward and even painful to use for many people, with long-term effects such as carpal tunnel syndrome.

Referring to FIGS. 2-11, a preferred embodiment of the slide operated scissors 100 is illustrated. The slide operated scissors generally include a non-movable first blade 102 a second blade 104, an upper shank 106, a finger ring 108, a thumb ring 110, a pivot 112, a tang 114 and a slide 116. The proximal end of the first blade 102 transitions into the upper shank 106, which in turn transitions into the finger ring 108, which in turn transitions into the tang 114. The proximal end 118 of the second blade 104 includes a drive slot 120 which cooperates with a drive pin 122. The drive pin 122 is secured to the slide 116 to be moveable therewith. The two blades 102, 104 are pivotally connected near their proximal ends by the pivot 112, which is typically a screw, pin or rivet. The pivot 112 of the preferred embodiment includes an adjustment knob 124 having internal threads to cooperate with external threads on the pivot 112 to allow an operator to adjust the pressure between the two blades. A spring tensioner 126 is provided to prevent the adjustment knob 124 from loosening due to movement of the blades. The pivot 112 also preferably includes a shaped shank 141 which cooperates with the fixed blade to prevent unwanted rotation of the pivot so that the adjustment knob does not become loosened from rotation of the blades with respect to each other.

Figure 8:
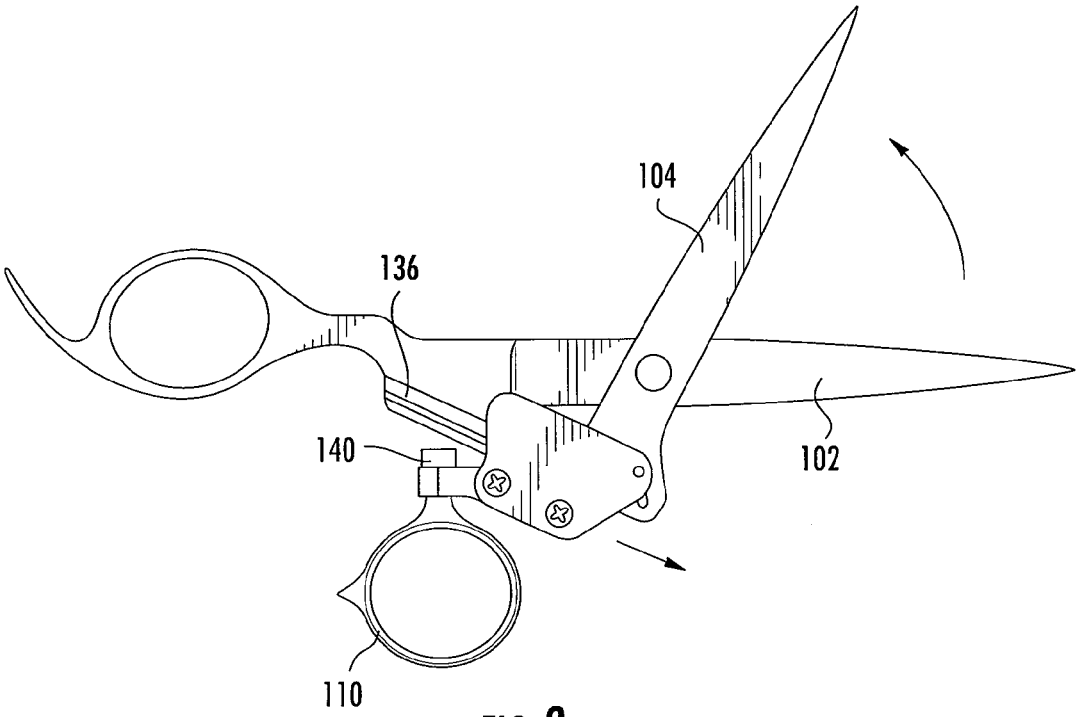
FIG. 8 is a side view, illustrating the blades in an open position.
Figure 9:
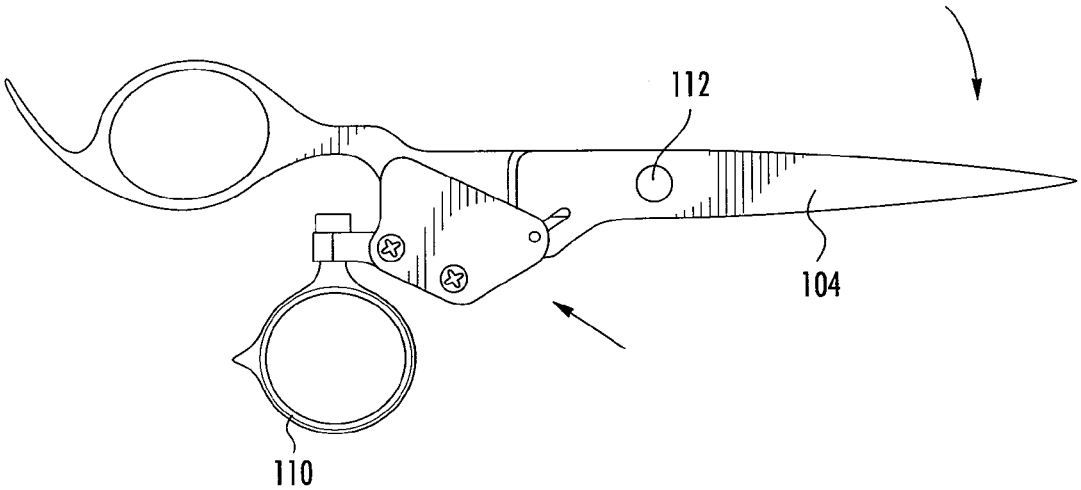
FIG. 9 is a side view illustrating the blades in a closed position.
Figure 10:
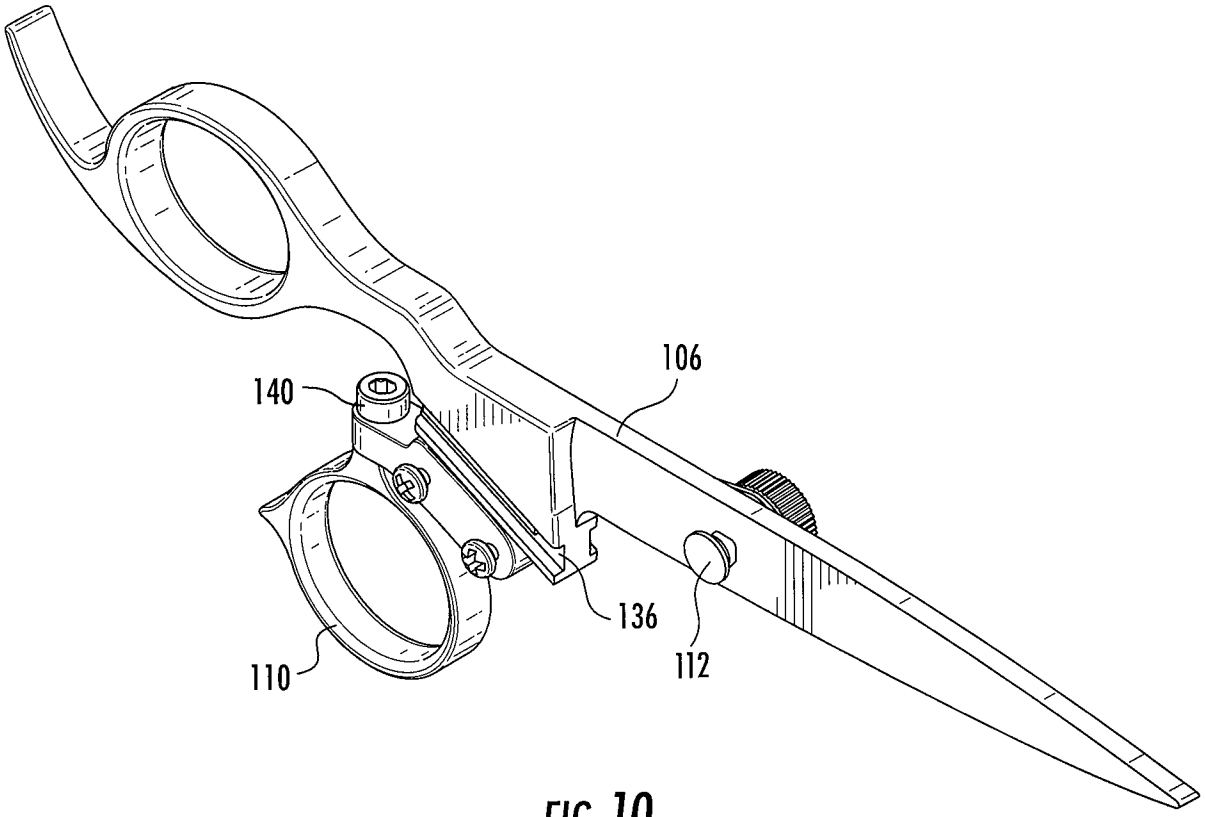
FIG. 10 is a partial perspective view, illustrated with the second blade and the slide removed for clarity.
Figure 11:
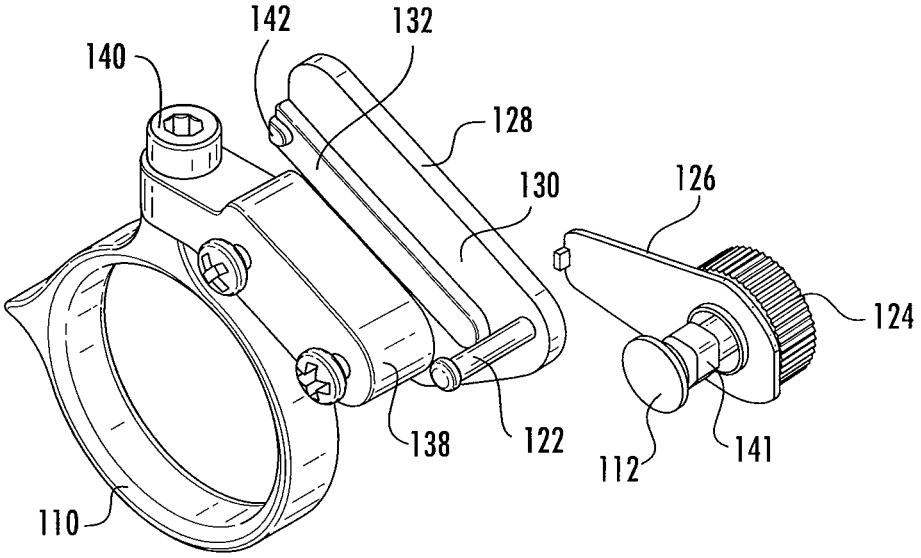
FIG. 11 is a partial perspective view, illustrating a portion of the slide and the pivot.

Still referring to FIGS. 2-11, the slide assembly of the preferred embodiment includes a pair of side plates 128 in a spaced apart and substantially parallel arrangement. An internal surface 130 (FIG. 11), of at least one, and more preferably each side plate 128 includes a key 132 sized and shaped to conjugately fit into a track 136 (FIG. 10) for guiding the slide 116 along a predetermined path. In a preferred embodiment the track(s) 136 is/are integrally formed along one or both sides of the upper shank 106. In at least one embodiment, a slider mount 138 is provided for mounting of the thumb ring 110 so that the thumb ring can rotate about a spindle 140. In operation, the operator places a finger in the finger ring 108 and the thumb in the thumb ring 110. The blades are then opened and closed as needed by sliding the slider fore and aft along the track whereby the drive pin 122 interacts with the drive slot 120 to cause the second blade 104 to open and close as illustrated in FIGS. 8 and 9. In at least one embodiment, a stop 142 (FIG. 7) is provided to prevent the blades from crossing beyond the fully overlapped position so as to avoid excessive blade wear and/or deformation. The slide operated scissors are preferably constructed from metal and more preferably from a carbon containing steel suitable for hardening. However, it should be noted that other metals, plastics or ceramics may be impregnated or include metal inserts without departing from the scope of the invention. It should also be noted that while the drive slot 120 and the track 136 are illustrated being substantially linear in the figures, either or both may include curves or combinations of curves and linear sections to provide a desired opening and closing action of the blades without departing from the scope of the invention.

All patents and publications mentioned in this specification are indicative of the levels of those skilled in the art to which the invention pertains.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A slide operated scissor assembly comprising:

a first blade, said first blade including a pivot assembly at a central portion thereof for securing a second blade thereto, said second blade secured to said first blade to pivot with respect to said first blade, said first blade and said second blade each including a cutting edge which oppose each other, said cutting edges cooperating in a crossing manner as said first blade and said second blade are pivoted with respect to each other, said first blade including a shank portion for grasping;

a slide assembly, said slide assembly being connected to said second blade, said slide assembly including a thumb member, said slide assembly includes a pair of internal surfaces arranged in a spaced apart and substantially parallel arrangement, at least one of said internal surfaces including a key member sized and shaped to conjugately fit into a track positioned along said shank portion of said first blade for guiding said slide assembly along a predetermined path, said slide assembly being constructed and arranged to slide along a portion of the first blade in a reciprocating motion for causing said second blade to pivot with respect to said first blade.

2. The slide operated scissor assembly of claim 1 wherein said shank portion of said first blade transitions into a finger ring.

3. The slide operated scissor assembly of claim 2 wherein said finger ring transitions into a tang.

4. The slide operated scissor assembly of claim 1 wherein said second blade includes a proximal end and a distal end, said distal end including said cutting edge, said proximal end including a drive slot, said slide assembly including a drive pin secured to a slide to be moveable therewith, said drive pin sized to fit within said drive slot whereby said second blade can be pushed and pulled via said slide to cause said second blade to pivot with respect to said first blade.

5. The slide operated scissor assembly of claim 4 wherein said drive slot is substantially linear in shape, thereby providing a substantially linear path for said drive pin.

6. The slide operated scissor assembly of claim 4 wherein said drive slot is curved in shape thereby providing a curved path for said drive pin.

7. The slide operated scissor assembly of claim 4 wherein said pivot assembly includes a stem, said stem having a non-round geometric shape, said first blade having an aperture for accepting said stem, said aperture having a shape that is substantially conjugate in shape to said stem to prevent rotation of said pivot assembly with respect to said first blade.

8. The slide operated scissor assembly of claim 7 wherein said geometric shape is a polygon.

9. The slide operated scissor assembly of claim 1 wherein said pivot assembly includes a tensioning member, said tensioning member being manually adjustable for adjusting the pressure between said first and said second blades.

10. The slide operated scissor assembly of claim 9 wherein said tensioning member includes a spring tensioner, said spring tensioner being constructed and arranged to apply spring tension to said tensioning member to prevent unwanted rotation thereof.

11. The slide operated scissor assembly of claim 1 wherein said slide assembly includes a pair of side plates arranged in a spaced apart and substantially parallel arrangement, and each side plate including a respective one of said internal surfaces.

12. The slide operated scissor assembly of claim 11 wherein each of said internal surface includes a key member, said track formed on both sides of said shank portion of said first blade for each said key member to guide said slide assembly along a predetermined path.

13. The slide operated scissor assembly of claim 11 wherein said slide assembly includes a slider mount for securing said thumb member to said slide assembly.

14. The slide operated scissor assembly of claim 13 wherein said slider mount is secured between said pair of side plates.

15. The slide operated scissor assembly of claim 14 wherein said thumb member is a thumb ring secured to said slider mount to be moveable therewith.

16. The slide operated scissor assembly of claim 15 wherein said thumb ring includes a spindle, said spindle allowing rotation of said thumb ring about a longitudinal axis of said spindle.

17. The slide operated scissor assembly of claim 11 wherein at least one of said pair of side plates includes a stop member, said stop member cooperating with said first blade to prevent said first and said second blades from crossing beyond a fully overlapped position.

18. The slide operated scissor assembly of claim 1 wherein said first blade and said second blade are constructed from metal.

19. A slide operated scissor assembly comprising:

a first blade and a second blade pivotally secured to said first blade for pivotal movement about a central portion thereof so that cutting edges of each respective blade contact each other during said pivotal movement, a slide assembly, said slide assembly being connected to said second blade, said slide assembly being constructed and arranged to slide along a portion of said first blade in a reciprocating motion for causing said second blade to pivot with respect to said first blade.

20. The slide operated scissor assembly of claim 19 wherein said slide assembly includes a thumb ring.

* * * * *